US007407923B2

(12) United States Patent
Wiedemann et al.

(10) Patent No.: US 7,407,923 B2
(45) Date of Patent: Aug. 5, 2008

(54) PACKAGED DETERGENT COMPOSITION

(75) Inventors: Ralf Wiedemann, Ludwigshafen (DE); Enric Carbonell, Barcelona (ES); Marcus Guzmann, Muehlhausen (DE)

(73) Assignee: Reckitt Benckiser N.V., Hoofddorp (NL)

( * ) Notice: Subject to any disclaimer, the term of this patent is extended or adjusted under 35 U.S.C. 154(b) by 0 days.

(21) Appl. No.: 10/505,624

(22) PCT Filed: Jan. 13, 2003

(86) PCT No.: PCT/GB03/00100

§ 371 (c)(1),
(2), (4) Date: Jul. 15, 2005

(87) PCT Pub. No.: WO03/072694

PCT Pub. Date: Sep. 4, 2003

(65) Prior Publication Data

US 2005/0261155 A1 Nov. 24, 2005

(30) Foreign Application Priority Data

Feb. 26, 2002 (GB) ..... 0204364.4

(51) Int. Cl.

| | |
|---|---|
| ***C11D 17/04*** | (2006.01) |
| ***C11D 17/00*** | (2006.01) |
| ***B08B 9/20*** | (2006.01) |
| ***D06L 1/00*** | (2006.01) |

(52) U.S. Cl. ..... 510/296; 510/220; 510/417; 510/418; 510/438; 510/439; 134/25.2; 8/137

(58) Field of Classification Search ..... 510/196, 510/220, 438, 417, 418, 439, 296; 134/25.2; 8/137

See application file for complete search history.

(56) References Cited

U.S. PATENT DOCUMENTS

| | | | | |
|---|---|---|---|---|
| 6,492,312 | B1 * | 12/2002 | Pfeiffer et al. | 510/221 |
| 6,521,581 | B1 * | 2/2003 | Hsu et al. | 510/297 |
| 7,074,748 | B2 * | 7/2006 | Becks et al. | 510/296 |
| 7,125,828 | B2 * | 10/2006 | Catlin et al. | 510/220 |
| 2005/0061703 | A1 * | 3/2005 | Catlin et al. | 206/524.1 |
| 2005/0065051 | A1 * | 3/2005 | Catlin et al. | 510/220 |
| 2006/0090779 | A1 * | 5/2006 | Sharma et al. | 134/146 |

FOREIGN PATENT DOCUMENTS

| | | |
|---|---|---|
| CH | 347 930 | 7/1960 |
| EP | 0 145 438 A | 6/1985 |
| EP | 0 233 027 A2 | 8/1987 |
| EP | 0 507 404 B1 | 10/1992 |
| EP | A-518720 | 12/1992 |
| EP | A-694059 | 1/1999 |
| EP | 1 201 744 A | 5/2002 |

(Continued)

*Primary Examiner*—Lorna M. Douyon
(74) *Attorney, Agent, or Firm*—Norris McLaughlin & Marcus, PA

(57) ABSTRACT

A packaged detergent composition comprising a container that at least partly disintegrates in an aqueous environment, the container having at least one compartment, the detergent composition having at least one fluid phase and at least one solid substantially insoluble in the fluid phase and having a size sufficient to be retained by a 2.5 mm mesh wherein the movement of the at least one solid within the container is restricted, as well as its use in an automatic dishwashing or laundry washing machine.

9 Claims, 1 Drawing Sheet

FOREIGN PATENT DOCUMENTS

| | | |
|---|---|---|
| GB | A-2244258 | 11/1991 |
| WO | WO 89/12587 | 12/1989 |
| WO | WO 99/06522 | 2/1999 |
| WO | WO 00/55045 | 9/2000 |
| WO | WO-A-0183658 | 11/2001 |
| WO | WO 02 057402 A | 7/2002 |

* cited by examiner

PACKAGED DETERGENT COMPOSITION

BACKGROUND OF THE INVENTION

1. Field of the Invention

The present invention relates to a packaged detergent composition comprising a container that at least partly disintegrates in an aqueous environment, the container having at least one compartment, the detergent composition having at least one liquid and at least one solid substantially insoluble in the liquid and having a size retained by a 2.5 mm mesh. The invention is particularly useful in automatic dishwashing machines and laundry washing machines.

2. The Related Art

It is known to use packaged detergent compositions, disintegrating in an aqueous environment, for example, because of being made of water-soluble material. Such containers can simply be added to water in order to dissolve or disperse its contents thereinto.

It is also known to manufacture such containers having more than one compartment to enable presence in the same container of compositions having some kind of mutual incompatibility.

It has equally been proposed to enclose more than one composition in the same compartment of such package, which may then have one, or more than one compartment. Examples of this can be found in Swiss patent application number 347 930, European patent application number EP 0 233 027 A2 and European patent number EP 0 507 404 B1.

It has been found, however, that when solids, having a relatively big size (more than 2.5 mm), are packaged within a container of the above type comprising a liquid composition the solids may interact with the walls of the packages developing a number of potential problems.

A first undesirable type of interaction is a chemical interaction and may arise when the composition of the solid comprises substances with some degree of incompatibility with the material of the [water-soluble] container. Examples of these situations may arise when a solid comprising a cross-linking agent (i.e. borate) are contained in [water-soluble] a container made of polyol materials (i.e. polyvinyl alcohol) or when a solid comprising a strong oxidant (i.e. chlorine bleach) are contained within a container made of a oxidation sensitive material. This type of interaction may cause from one side a loss of integrity of the package but also a substantial change of the physical properties of the container (most notably its speed of dissolution).

A second type of interaction is a physical interaction and may arise from the friction of the solid(s) with the walls of the container when the container is moved (i.e. during handling or transportation). This friction can damage the material of the container (i.e. by enlarging the size of already existing pores) and cause leakage of the liquid contained in the container.

SUMMARY OF THE INVENTION

It is the object of the present invention to provide a packaged detergent composition of the above described type avoiding at least the second of (physical interaction), preferably both (chemical and physical interaction) of the above-mentioned undesirable types of interaction between the solid contained in the container and the container walls.

This object is solved by restricting the movement of the at least one solid within the container.

In a first alternative of the present invention it is proposed to restrict the solid's movement by having the at least one liquid having an interface with either another liquid or a gas and selecting the density of the solid to float at said interface.

The simplest execution of this alternative is to package a liquid (by the use of the word liquid we include gels) leaving a free space filled with a gas, preferably air or any other gas, while selecting the density of the solid to make it float at the liquid gas interface.

Another possible execution of this first alternative is to use two non-miscible liquids of different densities while selecting the density of the solid to lay within the range defined by the density of the two liquid compositions thereby causing the solid to float at the interface of the two liquids.

In a second alternative under the present invention the compartment of the package comprising the solid has a relative size with respect to the size of the solid contained therein such that the movement of the solid within the compartment is restricted. The package can have additional compartments of any desired size. Preferred relative sizes of the solid(s) are such that the space within the container in which the solid is held is greater than 20% v/v, ideally greater than 50% v/v than the space occupied by the solid.

Preferably there are no more than 5, preferably less than 3, individual solid components in any single container. Preferably there is only one discrete solid within a single container. Ideally the solid is a spheroid shape, ideally containing no sharp edges or corners thus reducing damage to the container.

In a third alternative under the present invention the solid is attached at a fixed point on to one or more of the container's walls, preferably at a point, which is sufficiently far from the seal area of the container so that the solid will not contact the seal. It is possible to envisage different executions under this embodiment. One such execution comprises embedding the solid(s) at least partially within the material of the container's walls. Another alternative is to glue the solid(s) to the container's walls.

Figure 1:
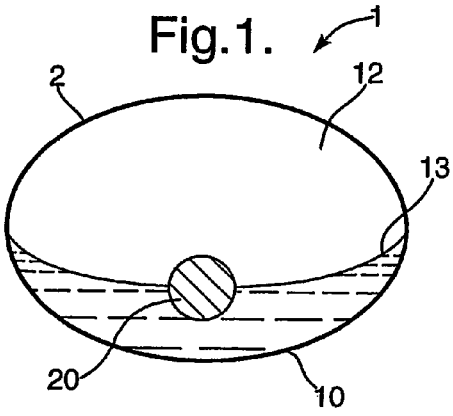
FIG. 1 shows a first mono-compartment embodiment of the packaged detergent composition of the present invention.

The present invention provides for a surprisingly simple solution to the above mentioned problems by restricting the free movement of the solid(s) within the container in a number of alternative ways. By imposing the restriction of the solid's movement within the container friction between the solid and the container is eliminated or at least substantially reduced and at the same time the degree of chemical interaction may also be reduced with some of the alternatives proposed to restrict the solid's movement.

In all executions under the present invention the packaging may be formed using different techniques known to the expert in the field of forming water-soluble packaging. As non-limiting examples of such techniques one can mention techniques making use of processes of moulding the water-soluble raw material of the packaging, especially injection moulding or blow moulding, and also techniques making use of a preformed film of water-soluble material such as thermoforming, vertical form-fill-sealing or horizontal form-fill-sealing.

In the case of techniques making use of preformed film materials, the film may be a single film, or a laminated film as disclosed in GB-A-2,244,258. While a single film may have pinholes, the two or more layers in a laminate are unlikely to have pinholes, which coincide.

The film itself may be produced by any process, for example by extrusion and blowing or by casting. The film may be unoriented, monoaxially oriented or biaxially oriented. If the layers in the film are oriented, they usually have the same orientation, although their planes of orientation may be different, if desired.

The layers in a laminate may be the same or different. Thus, they may each comprise the same polymer or a different polymer. Examples of water-soluble polymers which may be used in a single layer film or in one or more layers of a laminate or which may be used for injection moulding or blow moulding are poly(vinyl alcohol) (PVOH), cellulose derivatives such as hydroxypropyl methyl cellulose (HPMC) and gelatine. An example of a preferred PVOH is ethoxylated PVOH. The PVOH may be partially or fully alcoholised or hydrolysed. For example it may be from 40 to 100%, preferably from 70 to 92%, more preferably about 88% or about 92%, alcoholised or hydrolysed. The degree of hydrolysis is known to influence the temperature at which the PVOH starts to dissolve in water. 88% hydrolysis corresponds to a film soluble in cold (i.e. room temperature) water, whereas 92% hydrolysis corresponds to a film soluble in warm water.

The thickness of the film used to produce the container, which may be in the form of a pocket, is preferably 40 to 300 μm, more preferably 80 to 200 μm, especially 100 to 160 μm, more especially 100 to 150 μm and most especially 120 to 150 μm.

In one possible execution using film material the packaging may be formed by, for example, vacuum forming or thermoforming. For example, in a thermoforming process the film may be drawn down or blown down into a mould. Thus, for example, the film is heated to the thermoforming temperature using a thermoforming heater plate assembly, and then drawn down under vacuum or blown down under pressure into the mould. Plug-assisted thermoforming and pre-stretching the film, for example by blowing the film away from the mould before thermoforming, may, if desired, be used. One skilled in the art can choose an appropriate temperature, pressure or vacuum and dwell time to achieve an appropriate pocket. The amount of vacuum or pressure and the thermoforming temperature used depend on the thickness and porosity of the film and on the polymer or mixture of polymers being used. Thermoforming of PVOH films is known and described in, for example, WO 00/55045.

A suitable forming temperature for PVOH or ethoxylated PVOH is, for example, from 90 to 130° C., especially 90 to 120° C. A suitable forming pressure is, for example, 69 to 138 kPa (10 to 20 p.s.i.), especially 83 to 117 kPa (12 to 17 p.s.i.). A suitable forming vacuum is 0 to 4 kPa (0 to 40 mbar), especially 0 to 2 kPa (0 to 20 mbar). A suitable dwell time is, for example, 0.4 to 2.5 seconds, especially 2 to 2.5 seconds.

While desirably conditions are chosen within the above ranges, it is possible to use one or more of these parameters outside the above ranges, although it may be necessary to compensate by changing the values of the other two parameters.

When the container comprises more than one compartment, each compartment may be formed by any of the above mentioned techniques.

The compartments are then filled with the desired compositions. The compartments may be completely filled or only partially filled. The solid may be, for example, a particulate or granulated solid, or a tablet. The liquid may be non-aqueous or aqueous, for example comprising less than or more than 5% total or free water. The composition may have more than one phase. For example, it may comprise an aqueous liquid and a liquid which is immiscible with the aqueous liquid.

The container may contain more than one component; for instance it may contain two components which are incompatible with each other. It may also contain a component, which is incompatible with the part of the container enclosing the other component. For example, the second composition may be incompatible with the part of the container enclosing the first composition.

If it is desired that the container releases the components, it is possible to ensure that the components are released at different times. Thus, for instance, one composition can be released immediately the container is added to water, whereas the other may be released later. This may be achieved by having a compartment, which takes longer to dissolve surrounding one of the compositions, which may be either the first or the second composition. This may be achieved, for example, by having different compartment wall thicknesses. Alternatively, the second composition may simply be held on the outside of the sealing member, in which case it can start to dissolve as soon as the article is added to water. In the case of use of a multicompartment packaging different release times may also be achieved by choosing compartments, which dissolve at different temperatures, for example the different temperatures encountered during the cycle of a laundry or dish washing machine.

Alternatively the packaging may be formed of, for example, a moulded composition, especially one produced by injection moulding or blow moulding. The walls of the compartment may, for example, have a thickness of greater than 100 μm, for example greater than 150 μm or greater than 200 μm, 300 μm, 500 μm, 750 μm or 1 mm. Preferably the walls have a thickness of from 200 to 400 μm.

The composition may be a fabric care, surface care or dishwashing composition. Thus, for example, it may be a dishwashing, water softening, laundry or detergent composition, or a rinse aid. Such compositions may be suitable for use in a domestic washing machine. The composition may also be a disinfectant, antibacterial or antiseptic composition, or a refill composition for a trigger-type spray. Such compositions are generally packaged in amounts of from 5 to 100 g, especially from 15 to 40 g. For example, a dishwashing composition may weigh from 15 to 30 g, a water-softening composition may weigh from 15 to 40 g.

The composition, if in liquid form, may be anhydrous or comprise water, for example at least 5 wt %, preferably at least 10 wt %, water based on the weight of the aqueous composition.

In case more than one composition is packaged, the compositions may be the same or different. If they are different, they may, nevertheless, have one or more individual components in common.

In a possible execution a sealing member is placed on top of the first compartment previously filled and sealed thereto.

The sealing member may be produced by, for example, injection moulding or blow moulding. It may also be in the form of a film.

The sealing member may optionally comprise a second composition at the time it is placed on top of the first compartment. This may be held or otherwise adhered on the sealing member. For example it can be in the form of a solid composition such as a ball or pill held on the sealing member by an adhesive or mechanical means. This is especially appropriate when the sealing member has a degree of rigidity, such as when it has been produced by injection moulding. It is also possible for a previously prepared container containing the second composition to be adhered to the sealing member. For example, a sealing member in the form of a film may have a filled compartment containing a composition attached thereto. The second composition or compartment may be held on either side of the sealing member such that it is inside or outside the first compartment.

Generally, however, the second composition is held within a second compartment in the sealing member. This is especially appropriate when the sealing member is flexible, for example in the form of a film.

The sealing member is placed on top of the first compartment and sealed thereto. For example the sealing member in the form of a film may be placed over a filled pocket and across the sealing portion, if present, and the films sealed together at the sealing portion. In general there is only one second compartment or composition in or on the sealing member, but it is possible to have more than one second compartment or composition, if desired, for example 2 or 3 second compartments or compositions.

The second compartment may be formed by any technique. For example it can be formed by vertical form fill sealing the second composition within a film, such as by the process described in WO 89/12587. It can also be formed by having an appropriate shape for injection moulding.

However, it is preferred to use a vacuum forming or thermoforming technique, such as that previously described in relation to the first compartment of the container of the present invention. Thus, for example, a pocket surrounded by a sealing portion is formed into a film, the pocket is filled with the second composition, a film is placed on top of the filled pocket and across the sealing portion and the films are sealed together at the sealing portion. In general, however, the film placed on top of the filled pocket to form the second compartment does not itself comprise a further compartment.

Further details of this thermoforming process are generally the same as those given above in relation to the first compartment of the container of the present invention. All of the above details are incorporated by reference thereto, with the following differences:

The second compartment is generally smaller than the first compartment, since the film containing the second composition is used to form a lid on the pocket. In general the first compartment and the second compartment (or composition if not held within a compartment) have a volume ratio of from 2:1 to 20:1, more preferably 4:1 to 10:1. Generally the second compartment does not extend across the sealing portion.

The thickness of the film comprising the second compartment may also be less than the thickness of the film making up the first compartment of the container of the present invention, because the film is not subjected to as much localised stretching in the thermoforming step. It is also desirable to have a thickness which is less than that of the film used to form the first compartment to ensure a sufficient heat transfer through the film to soften the base web, if heat sealing is used.

The thickness of the covering film is generally from 20 to 160 μm, preferably from 40 to 100 μm, such as 40 to 80 μm or 50 to 60 μm.

This film may be a single-layered film, but is desirably laminated to reduce the possibility of pinholes allowing leakage through the film. The film may be the same as or different from the film forming the first compartment. If two or more films are used to form the film comprising the second compartment, the films may be the same or different. Examples of suitable films are those given for the film forming the first compartment.

The first compartment and the sealing member may be sealed together by any suitable means, for example by means of an adhesive or by heat sealing. Mechanical means is particularly appropriate if both have been prepared by injection moulding. Other methods of sealing include infrared, radio frequency, ultrasonic, laser, solvent, vibration and spin welding. An adhesive such as an aqueous solution of PVOH may also be used. The seal desirably is water-soluble if the containers are water-soluble.

If heat sealing is used, a suitable sealing temperature is, for example, 120 to 195° C., for example 140 to 150° C. A suitable sealing pressure is, for example, from 250 to 600 kPa. Examples of sealing pressures are 276 to 552 kPa (40 to 80 p.s.i.), especially 345 to 483 kPa (50 to 70 p.s.i.) or 400 to 800 kPa (4 to 8 bar), especially 500 to 700 kPa (5 to 7 bar) depending on the heat-sealing machine used. Suitable sealing dwell times are 0.4 to 2.5 seconds.

One skilled in the art can use an appropriate temperature, pressure and dwell time to achieve a seal of the desired integrity. While desirably conditions are chosen within the above ranges, it is possible to use one or more of these parameters outside the above ranges, although it would might be necessary to compensate by changing the values of the other two parameters.

In a second embodiment of the invention, the sealing member does not comprise the second composition at the time it is placed on top of the first component. Instead the second composition is added afterwards. Thus, for example, it may be adhered to the sealing member by means of an adhesive. It may also be adhered by mechanical means, particularly when the sealing member has a degree of rigidity, for example when injection moulding has produced it. Another possibility is for the sealing member to contain an indentation, which is filled, either before or after sealing, by a liquid composition, which is allowed to gel in-situ.

If more than one container is formed at the same time from the same sheet, the containers may then be separated from each other, for example by cutting the sealing portions, or flanges. Alternatively, they may be left conjoined and, for example, perforations provided between the individual containers so that they can be easily separated a later stage, for example by a consumer. If the containers are separated, the flanges may be left in place. However, desirably the flanges are partially removed in order to provide an even more attractive appearance. Generally the flanges remaining should be as small as possible for aesthetic purposes while bearing in mind that some flange is required to ensure the two films remain adhered to each other. A flange having a width of 1 mm to 8 mm is desirable, preferably 2 mm to 7 mm, most preferably about 5 mm.

The containers may themselves be packaged in outer containers if desired, for example non-water soluble containers, which are removed, before the water-soluble containers are used.

The containers produced by the process of the present invention, especially when used for a fabric care, surface care or dishwashing composition, may have a maximum dimension of 5 cm, excluding any flanges. For example, a container may have a length of 1 to 5 cm, especially 3.5 to 4.5 cm, a width of 1.5 to 3.5 cm, especially 2 to 3 cm, and a height of 1 to 2 cm, especially 1.25 to 1.75 cm.

The ingredients of the compositions depend on the use of such compositions. Thus, for example, the composition may contain surface-active agents such as an anionic, nonionic, cationic, amphoteric or zwitterionic surface-active agents or mixtures thereof.

Examples of anionic surfactants are straight-chained or branched alkyl sulfates and alkyl polyalkoxylated sulfates, also known as alkyl ether sulfates. Such surfactants may be produced by the sulfation of higher $C_8$-$C_{20}$ fatty alcohols.

Examples of primary alkyl sulfate surfactants are those of formula:

$$ROSO_3^-M^+$$

wherein R is a linear $C_8$-$C_{20}$ hydrocarbyl group and M is a water-solubilising cation. Preferably R is $C_{10}$-$C_{16}$ alkyl, for example $C_{12}$-$C_{14}$, and M is alkali metal such as lithium, sodium or potassium.

Examples of secondary alkyl sulfate surfactants are those which have the sulfate moiety on a "backbone" of the molecule, for example those of formula:

$$CH_2(CH_2)_n(CHOSO_3^-M^+)(CH_2)_mCH_3$$

wherein m and n are independently 2 or more, the sum of m+n typically being 6 to 20, for example 9 to 15, and M is a water-solubilising cation such as lithium, sodium or potassium.

Especially preferred secondary alkyl sulfates are the (2,3) alkyl sulfate surfactants of formulae:

$$CH_2(CH_2)_x(CHOSO_3^-M^+)CH_3 \text{ and}$$

$$CH_3(CH_2)_x(CHOSO_3^-M^+)CH_2CH_3$$

for the 2-sulfate and 3-sulfate, respectively. In these formulae x is at least 4, for example 6 to 20, preferably 10 to 16. M is cation, such as an alkali metal, for example lithium, sodium or potassium.

Examples of alkoxylated alkyl sulfates are ethoxylated alkyl sulfates of the formula:

$$RO(C_2H_4O)_nSO_3^-M^+$$

wherein R is a $C_8$-$C_{20}$ alkyl group, preferably $C_{10}$-$C_{18}$ such as a $C_{12}$-$C_{16}$, n is at least 1, for example from 1 to 20, preferably 1 to 15, especially 1 to 6, and M is a salt-forming cation such as lithium, sodium, potassium, ammonium, alkylammonium or alkanolammonium. These compounds can provide especially desirable fabric cleaning performance benefits when used in combination with alkyl sulfates.

The alkyl sulfates and alkyl ether sulfates will generally be used in the form of mixtures comprising varying alkyl chain lengths and, if present, varying degrees of alkoxylation.

Other anionic surfactants, which may be employed, are salts of fatty acids, for example $C_8$-$C_{18}$ fatty acids, especially the sodium or potassium salts, and alkyl, for example $C_8$-$C_{18}$, benzene sulfonates.

Examples of nonionic surfactants are fatty acid alkoxylates, such as fatty acid ethoxylates, especially those of formula:

$$R(C_2H_4O)_nOH$$

wherein R is a straight or branched $C_8$-$C_{16}$ alkyl group, preferably a $C_9$-$C_{15}$, for example $C_{10}$-$C_{14}$, alkyl group and n is at least 1, for example from 1 to 16, preferably 2 to 12, more preferably 3 to 10.

The alkoxylated fatty alcohol nonionic surfactant will frequently have a hydrophilic-lipophilic balance (HLB) which ranges from 3 to 17, more preferably from 6 to 15, most preferably from 10 to 15.

Examples of fatty alcohol ethoxylates are those made from alcohols of 12 to 15 carbon atoms and which contain about 7 moles of ethylene oxide. Such materials are commercially marketed under the trademarks Neodol 25-7 and Neodol 23-6.5 by Shell Chemical Company. Other useful Neodols include Neodol 1-5, an ethoxylated fatty alcohol averaging 11 carbon atoms in its alkyl chain with about 5 moles of ethylene oxide; Neodol 23-9, an ethoxylated primary $C_{12}$-$C_{13}$ alcohol having about 9 moles of ethylene oxide; and Neodol 91-10, an ethoxylated $C_9$-$C_{11}$ primary alcohol having about 10 moles of ethylene oxide.

Alcohol ethoxylates of this type have also been marketed by Shell Chemical Company under the Dobanol trademark. Dobanol 91-5 is an ethoxylated $C_9$-$C_{11}$ fatty alcohol with an average of 5 moles ethylene oxide and Dobanol 25-7 is an ethoxylated $C_{12}$-$C_{15}$ fatty alcohol with an average of 7 moles of ethylene oxide per mole of fatty alcohol.

Other examples of suitable ethoxylated alcohol nonionic surfactants include Tergitol 15-S-7 and Tergitol 15-S-9, both of which are linear secondary alcohol ethoxylates available from Union Carbide Corporation. Tergitol 15-S-7 is a mixed ethoxylated product of a $C_{11}$-$C_{15}$ linear secondary alkanol with 7 moles of ethylene oxide and Tergitol 15-S-9 is the same but with 9 moles of ethylene oxide.

Other suitable alcohol ethoxylated nonionic surfactants are Neodol 45-11, which is a similar ethylene oxide condensation products of a fatty alcohol having 14-15 carbon atoms and the number of ethylene oxide groups per mole being about 11. Such products are also available from Shell Chemical Company.

Further nonionic surfactants are, for example, $C_{10}$-$C_{18}$ alkyl polyglycosides, such s $C_{12}$-$C_{16}$ alkyl polyglycosides, especially the polyglucosides. These are especially useful when high foaming compositions are desired. Further surfactants are polyhydroxy fatty acid amides, such as $C_{10}$-$C_{18}$ N-(3-methoxypropyl) glucamides and ethylene oxide-propylene oxide block polymers of the Pluronic type.

Examples of cationic surfactants are those of the quaternary ammonium type.

The total content of surfactants in the composition is desirably 60 to 95 wt %, especially 75 to 90 wt %. Desirably an anionic surfactant is present in an amount of 50 to 75 wt %, the nonionic surfactant is present in an amount of 5 to 20 wt %, and/or the cationic surfactant is present in an amount of from 0 to 20 wt %. The amounts are based on the total solids content of the composition, i.e. excluding any solvent, which may be present.

The composition, particularly when used as laundry washing or dishwashing composition, may also comprise enzymes, such as protease, lipase, amylase, cellulase and peroxidase enzymes. Such enzymes are commercially available and sold, for example, under the registered trademarks Esperase, Alcalase and Savinase by Novo Industries A/S and Maxatase by International Biosynthetics, Inc. Desirably the enzymes are present in the composition in an amount of from 0.5 to 3 wt %, especially 1 to 2 wt %.

The composition may, if desired, comprise a thickening agent or gelling agent. Suitable thickeners are polyacrylate polymers such as those sold under the trademark CARBOPOL, or the trademark ACUSOL by Rohm and Haas Company. Other suitable thickeners are xanthan gums. The thickener, if present, is generally present in an amount of from 0.2 to 4 wt %, especially 0.5 to 2 wt %.

Dishwasher compositions usually comprise a detergency builder. Suitable builders are alkali metal or ammonium phosphates, polyphosphates, phosphonates, polyphosphonates, carbonates, bicarbonates, borates, polyhydroxysulfonates, polyacetates, carboxylates such as citrates, and polycarboxylates. The builder is desirably present in an amount of up to 90 wt %, preferably 15 to 90 wt %, more preferable 15 to 75 wt %, relative to the total weight of the composition. Further details of suitable components are given in, for example, EP-A-694,059, EP-A-518,720 and WO 99/06522.

The compositions can also optionally comprise one or more additional ingredients. These include conventional detergent composition components such as further surfactants, bleaches, bleach enhancing agents, builders, suds boosters or suds suppressors, anti-tarnish and anti-corrosion agents, organic solvents, co-solvents, phase stabilisers, emulsifying agents, preservatives, soil suspending agents, soil release agents, germicides, pH adjusting agents or buffers, non-builder alkalinity sources, chelating agents, clays such as smectite clays, enzyme stabilisers, anti-limescale agents, colorants, dyes, hydrotropes, dye transfer inhibiting agents, brighteners, and perfumes. If used, such optional ingredients will generally constitute no more than 10 wt %, for example from 1 to 6 wt %, the total weight of the compositions.

The builders counteract the effects of calcium, or other ion, water hardness encountered during laundering or bleaching use of the compositions herein. Examples of such materials are citrate, succinate, malonate, carboxymethyl succinate, carboxylate, polycarboxylate and polyacetyl carboxylate salts, for example with alkali metal or alkaline earth metal cations, or the corresponding free acids. Specific examples are sodium, potassium and lithium salts of oxydisuccinic acid, mellitic acid, benzene polycarboxylic acids, $C_{10}$-$C_{22}$ fatty acids and citric acid. Other examples are organic phosphonate type sequestering agents such as those sold by Monsanto under the trademark Dequest and alkylhydroxy phosphonates. Citrate salts and $C_{12}$-$C_{18}$ fatty acid soaps are preferred.

Other suitable builders are polymers and copolymers known to have builder properties. For example, such materials include appropriate polyacrylic acid, polymaleic acid, and polyacrylic/polymaleic acid copolymers and their salts, such as those sold by BASF under the trademark Sokalan.

The builders generally constitute from 0 to 3 wt %, more preferably from 0.1 to 1 wt %, by weight of the compositions.

Compositions, which comprise an enzyme, may optionally contain materials, which maintain the stability of the enzyme. Such enzyme stabilisers include, for example, polyols such as propylene glycol, boric acid and borax. Combinations of these enzyme stabilisers may also be employed. If utilised, the enzyme stabilisers generally constitute from 0.1 to 1 wt % of the compositions.

The compositions may optionally comprise materials, which serve as phase stabilisers and/or co-solvents. Examples are $C_1$-$C_3$ alcohols such as methanol, ethanol and propanol. $C_1$-$C_3$ alkanolamines such as mono-, di- and triethanolamines can also be used, by themselves or in combination with the alcohols. The phase stabilisers and/or co-solvents can, for example, constitute 0 to 1 wt %, preferably 0.1 to 0.5 wt %, of the composition.

The compositions may optionally comprise components, which adjust or maintain the pH of the compositions at optimum levels. The pH may be from, for example, 1 to 13, such as 8 to 11 depending on the nature of the composition. For example a dishwashing composition desirably has a pH of 8 to 11, a laundry composition desirable has a pH of 7 to 9, and a water-softening composition desirably has a pH of 7 to 9. Examples of pH adjusting agents are NaOH and citric acid.

The primary composition and the secondary composition may be appropriately chosen depending on the desired use of the article.

If the article is for use in laundry washing, the first composition may comprise, for example, a detergent, and the second composition may comprise a bleach, stain remover, water-softener, enzyme or fabric conditioner. The article may be adapted to release the compositions at different times during the laundry wash. For example, a bleach or fabric conditioner is generally released at the end of a wash, and a water softener is generally released at the start of a wash. An enzyme may be released at the start or the end of a wash.

If the article is for use as a fabric conditioner, the first composition may comprise a fabric conditioner and the second composition may comprise an enzyme, which is released before or after the fabric conditioner in a rinse cycle.

If the article is for use in dish washing the first composition may comprise a detergent and the second composition may comprise a water-softener, salt, enzyme, rinse aid, bleach or bleach activator. The article may be adapted to release the compositions at different times during the laundry wash. For example, a rinse aid, bleach or bleach activator is generally released at the end of a wash, and a water softener, salt or enzyme is generally released at the start of a wash.

The containers of the present invention will now be further described with reference to FIGS. 1 to 5. These illustrate examples of containers, which can be produced Each figure shows an article containing a liquid (or gel) composition and a solid having a size retained in a 2.5 mm mesh.

Figure 2:
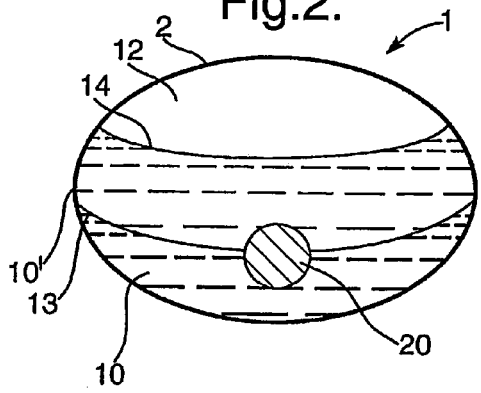
FIG. 2 shows another mono-compartment embodiment of the packaged detergent composition of the present invention.
Figure 3:
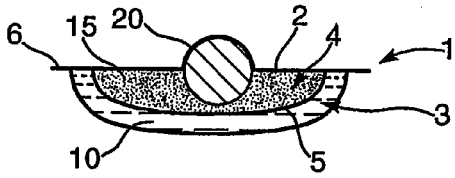
FIG. 3 shows the first multi-compartment embodiment of the packaged detergent composition of the present invention.
Figure 4:
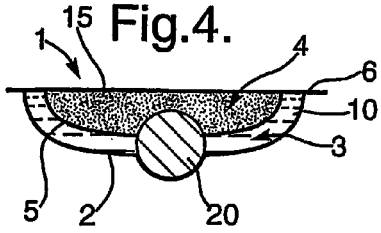
FIG. 4 shows a multi-compartment embodiment of the packaged detergent composition of the present invention where the solid is restricted in its movement by "encapsulating".
Figure 5:
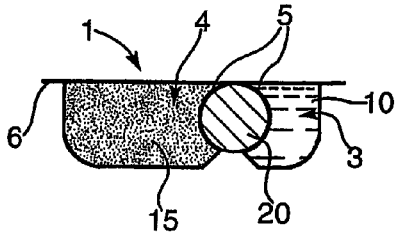
FIG. 5 shows another multi-compartment embodiment of the packaged detergent composition of the present invention.

FIGS. 1 to 5 are schematic representations of different embodiments of the packaged detergent composition according to the present invention, wherein FIGS. 1 and 2 show mono-compartment embodiments, whereas FIGS. 3, 4, and 5 show multi-compartment embodiments.

In all figures the same reference numerals have been used for similar parts.

FIG. 1 shows a first mono-compartment embodiment of the packaged detergent composition of the present invention. A container 1, preferably made of water-soluble material, contains two different phases, namely a liquid (or gel) phase 10 and a gaseous phase 12. A solid 20 can be seen floating at the liquid gas interface 11. By adjusting the density of the solid 20 to be comprised between the density of the liquid phase 10 and the density of the gaseous phase 12, the movement of the solid 20 is restricted to be in the region of liquid gas interface 13 whereby a contact with the outer wall 2 of the container 1 is reliably avoided.

Another mono-compartment embodiment of the packaged detergent composition of the present invention can be seen from FIG. 2. The difference to the embodiment of FIG. 1 is the presence of two liquid (or gel) phases (or one liquid and one gel phase) instead of only one liquid (or gel) phase, being immiscible and having different densities. Again a gaseous phase 12 can be seen on top of the second liquid phase 10'.

In this embodiment, the density of the solid 20 is adjusted to be between the density of the first liquid phase 10 and the density of the second liquid phase 10' so that it is floating at the liquid interface 13 of the two phases. Alternatively, the density of the solid could also be adjusted to be between the density of the second liquid phase 10' and the gaseous phase 12 to float at the liquid gas interface 14 (as in FIG. 1). Again, adjustment of the density of the solid between the densities of two of the phases thereby resulting in a floating of the solid at the respective interface, reliably avoiding any contact of the solid with the outer wall 2 of the container 1.

FIG. 3 shows the first multi-compartment embodiment of the packaged detergent composition of the present invention. In the specific embodiment of FIG. 3, compartment 3 of the container 1 contains a gel composition 10 whereas compartment 4 thereof contains a powder composition 15. Compartments 3 and 4 are separated by separation wall 5. The solid 20 in this case is attached, for example glued, at a point or area on the top portion of outer wall 2 of the container 1. For the reasons set out herein-above, this point or area 2 is located sufficiently far from the seal area 6 of the container so that the solid 20 will not get into contact with the seal.

A further, related embodiment is shown in FIG. 4, where the solid is restricted in its movement by "encapsulating" it within a part of compartment 3 kept between the outer wall 2 and the separation wall 5. Again, the solid is located sufficiently far from the seal area 6 to avoid contact.

Finally, FIG. 5 shows another multi-compartment embodiment of the packaged detergent composition of the present invention. In this embodiment the two compartments, namely compartment 3 with e.g. gel material 10 and compartment 4 with e.g. powder material 15, are arranged side by side separated by a separation wall 5. Again, similar to FIG. 4, solid 20 is "encapsulated" in an area of the separation wall sufficiently far from the seal area 6.

It is obvious for someone skilled in the art that there are more and other embodiments of the packaged detergent composition of the present application achieving the basic feature of the invention, namely to restrict the movement of the solid within the container.

The features disclosed in the foregoing description, in the claims and/or drawings may, both separately and in any combination thereof be material for realising the invention in diverse forms thereof.

The invention claimed is:

1. A packaged detergent composition comprising a container that at least partly disintegrates in an aqueous environment, the container having a compartment, the detergent composition having a first fluid phase, a second fluid phase and a solid, having a size sufficient to be retained by a 2.5 mm mesh, substantially insoluble in the first fluid phase and second fluid phase wherein the movement of the solid within the container is restricted and at least one compartment of the container holds a portion of said first fluid phase and said second fluid phase, said first fluid phase having a density different from the density of the second fluid phase and the said solid has a density comprised between the density of said first fluid phase and the density of said second fluid phase wherein the solid floats at an interface between said first fluid phase and said second fluid phase wherein the solid is at least partly in contact with an outer wall of the container and/or a separation wall between compartments of the container.

2. A packaged detergent composition according to claim 1 wherein the first fluid phase and the second fluid phase are mutually immiscible.

3. A packaged detergent composition according to claim 1 wherein that the solid is attached at a fixed point or area onto the walls of the container.

4. A packaged detergent composition according to claim 3 wherein the point or area where the solid is attached is sufficiently far from a seal area so that the solid does not contact the seal area.

5. A packaged detergent composition according to claim 3 wherein the solid is glued to a fixed point or area on the container walls.

6. A method of washing dishes comprising the step of providing the packaged detergent composition according to claim 1 in an automatic dishwashing machine.

7. A method of washing laundry comprising the step of providing the packaged detergent composition according to claim 1 in a laundry washing machine.

8. A packaged detergent composition comprising a container that at least partly disintegrates in an aqueous environment, the container having a compartment, the detergent composition having a first fluid phase, a second fluid phase and one solid, having a size sufficient to be retained by a 2.5 mm mesh, substantially insoluble in the first fluid phase and second fluid phase wherein the movement of the solid within the container is restricted wherein the solid floats at an interface between said first fluid phase and said second fluid phase and the solid is at least partly in contact with an outer wall of the container and/or a separation wall between compartments of the container and is attached at a fixed point or area onto the walls of the container sufficiently far from a seal area so that the solid does not come into contact with the seal area.

9. A packaged detergent composition comprising a container that at least partly disintegrates in an aqueous environment, the container having a compartment, the detergent composition having a fluid phase and a solid, having a size sufficient to be retained by a 2.5 mm mesh, substantially insoluble in the fluid phase wherein the movement of the solid within the container is restricted wherein the solid is at least partly in contact with an outer wall of the container and/or a separation wall between compartments of the container and is glued at a fixed point or area onto the walls of the container.

* * * * *